US008151905B2

(12) United States Patent
Song

(10) Patent No.: US 8,151,905 B2
(45) Date of Patent: Apr. 10, 2012

(54) DOWNHOLE TELEMETRY SYSTEM AND METHOD

(75) Inventor: Haoshi Song, Sugarland, TX (US)

(73) Assignee: HS International, L.L.C., Sugar Land, TX (US)

( * ) Notice: Subject to any disclaimer, the term of this patent is extended or adjusted under 35 U.S.C. 154(b) by 996 days.

(21) Appl. No.: 12/123,033

(22) Filed: May 19, 2008

(65) Prior Publication Data

US 2009/0285054 A1 Nov. 19, 2009

(51) Int. Cl.
*E21B 47/18* (2012.01)

(52) U.S. Cl. ..... 175/57; 175/40; 340/854.3; 367/84

(58) Field of Classification Search ..... 175/40, 175/57; 340/854.3, 854.4; 367/84, 85
See application file for complete search history.

(56) References Cited

U.S. PATENT DOCUMENTS

| | | | | |
|---|---|---|---|---|
| 2,963,099 | A | | 12/1960 | Gianelloni, Jr. |
| 3,194,325 | A | | 7/1965 | Gianelloni, Jr. |
| 3,309,656 | A | | 3/1967 | Godbey |
| 3,588,804 | A | | 6/1971 | Fort |
| 3,764,969 | A | * | 10/1973 | Cubberly, Jr. ..... 367/84 |
| 3,789,355 | A | | 1/1974 | Patton |
| 3,792,429 | A | | 2/1974 | Patton et al. |
| 3,863,203 | A | | 1/1975 | Patton et al. |
| 3,867,714 | A | * | 2/1975 | Patton ..... 367/85 |
| 3,949,354 | A | | 4/1976 | Claycomb |
| 3,958,217 | A | | 5/1976 | Spinnler |
| 3,964,558 | A | | 6/1976 | Fogle |
| 3,982,224 | A | | 9/1976 | Patton |
| 4,100,528 | A | | 7/1978 | Bernard et al. |
| RE29,734 | E | | 8/1978 | Manning |
| 4,167,000 | A | | 9/1979 | Bernard et al. |
| 4,216,536 | A | | 8/1980 | More |
| 4,302,757 | A | | 11/1981 | Still |
| 4,320,473 | A | | 3/1982 | Smither et al. |
| 4,396,071 | A | | 8/1983 | Stephens |
| 4,401,134 | A | | 8/1983 | Dailey |
| 4,515,225 | A | | 5/1985 | Dailey |
| 4,525,715 | A | | 6/1985 | Smith |
| 4,691,203 | A | | 9/1987 | Rubin et al. |
| 4,785,300 | A | | 11/1988 | Chin et al. |
| 4,956,823 | A | | 9/1990 | Russell et al. |
| 4,992,997 | A | | 2/1991 | Bseisu |
| 5,073,877 | A | | 12/1991 | Jeter |
| 5,157,464 | A | | 10/1992 | Laihanen |
| 5,182,760 | A | | 1/1993 | Montgomery |
| 5,222,049 | A | | 6/1993 | Drumheller |
| 5,448,227 | A | | 9/1995 | Orban et al. |
| 5,467,832 | A | | 11/1995 | Orban et al. |

(Continued)

*Primary Examiner* — Kenneth L Thompson
(74) *Attorney, Agent, or Firm* — Conley Rose, P.C.

(57) ABSTRACT

A downhole telemetry system for use in a wellbore including borehole fluid. The system includes a stator including flow channels though the stator and a rotor including flow channels though the rotor. The rotor is rotatable on a drive shaft by the force of the borehole fluid flowing through the rotor. The rotation of the rotor creates pressure variations in the borehole fluid related to the movement of the rotor channels relative to the stator channels, thus forming a carrier wave. A regulating system adjusts the amount of fluid force on the rotor for a given flow rate of borehole fluid to maintain the frequency of the carrier wave within a range of a target frequency. Also, an alternator drivable by the rotation of the drive shaft provides power to the system. The system also includes an encoder capable of adjusting the rotation of the rotor to modulate the carrier wave.

18 Claims, 5 Drawing Sheets

U.S. PATENT DOCUMENTS 5,517,464 A 5/1996 Lerner et al.
5,586,083 A 12/1996 Chin et al.
5,586,084 A 12/1996 Barron et al.
5,703,836 A 12/1997 Drumheller
6,075,462 A 6/2000 Smith
6,094,401 A 7/2000 Masak et al.
6,137,747 A 10/2000 Shah et al.
6,160,492 A 12/2000 Herman
6,219,301 B1 * 4/2001 Moriarty ..... 367/84
6,714,138 B1 * 3/2004 Turner et al. ..... 340/854.3
6,854,953 B2 2/2005 Van Drentham-Susman et al.
6,970,398 B2 11/2005 Lavrut et al.
7,327,634 B2 * 2/2008 Perry et al. ..... 367/84
2007/0182583 A1 * 8/2007 Feluch ..... 340/855.4

* cited by examiner

DOWNHOLE TELEMETRY SYSTEM AND METHOD

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The recovery of subterranean hydrocarbons, such as oil and gas, usually requires drilling boreholes thousands of feet deep. In addition to an oil rig on the surface, drilling oil and gas wells is carried out by means of a string of drill pipes connected together so as to form a drill string. Connected to the lower end of the drill string is a drill bit. The bit is typically rotated and is done so by either rotating the drill string, or by use of a downhole motor near the drill bit, or both. Drilling fluid, called "mud," is pumped down through the drill string at high pressures and volumes (such as 3000 psi at flow rates of up to 1400 gallons per minute) to emerge through nozzles or jets in the drill bit. The mud then travels back up the hole via the annulus formed between the exterior of the drill string and the wall of the borehole. On the surface, the drilling mud is cleaned and then recirculated. The drilling mud is used to cool and lubricate the drill bit, to carry cuttings from the base of the bore to the surface, and to balance the hydrostatic pressure in the rock formations.

Modern well drilling techniques, particularly those concerned with the drilling of oil and gas wells, involve the use of several different measurement and telemetry systems to provide data regarding the formation and data regarding drilling mechanics during the drilling process. Techniques for measuring conditions downhole and the movement and location of the drilling assembly, contemporaneously with the drilling of the well, have come to be known as "measurement-while-drilling" techniques, or "MWD." With MWD tools, data is acquired by sensors located in the drill string near the bit. This data is stored in downhole memory or may be transmitted to the surface using a telemetry system such as a mud flow telemetry device. Mud flow telemetry devices use a modulator to transmit information to an uphole or surface detector in the form of acoustic pressure waves which are modulated through the mud that is normally circulated under pressure through the drill string during drilling operations. A typical modulator is provided with a fixed stator and a motor driven rotatable rotor, each of which is formed with a plurality of spaced apart lobes. Gaps between adjacent lobes provide a plurality of openings or ports for the mud flow stream. When the ports of the stator and rotor are in direct alignment, they provide the greatest passageway for the flow of drilling mud through the modulator. When the rotor rotates relative to the stator, the alignment between the respective ports is shifted, thus interrupting the flow of mud and generating pressure pulses in the nature of acoustic signals. A motor is typically used to control the rotor to rotate at a constant velocity, thus producing a base signal with base frequency. However, by selectively slightly varying the rotation of the rotor, the base signal is modulated with encoded pressure pulses.

Both the downhole sensors and the modulator of the MWD tool require electric power. Since it is typically not feasible to run an electric power supply cable from the surface through the drill string to the sensors or the modulator, electric power must be obtained downhole. Power may be obtained downhole either from a battery pack or a turbine-generator. While the sensor electronics in a typical MWD tool may only require 3 watts of power, the modulator may require at least 60 watts and may require up to 700 watts of power. With these power requirements, power is typically provided using mud driven turbine-generators in the drill string downstream of the modulator with the sensor electronics located between the turbine and the modulator.

As mentioned above, the modulator is provided with a rotor mounted on a shaft and a fixed stator defining channels through which the mud flows. Rotation of the rotor relative to the stator acts like a valve to cause pressure modulation of the mud flow. The turbine-generator is provided with turbine blades (an impeller) which are coupled to a shaft which drives an alternator. Jamming problems are often encountered with turbine powered systems. In particular, if the modulator jams in a partially or fully closed position because of the passage of solid materials in the mud flow, the downstream turbine will temporarily slow down and reduce the power available to the modulator. Under reduced power, it is difficult or impossible to rotate the rotor of the modulator. Thus, while turbines generally provide ample power, they can fail to provide ample power due to jamming of the modulator. While batteries are not subject to power reduction due to jamming of the modulator, they produce less power than turbine-generators and eventually fail. In either case, therefore, conservation of downhole power is a prime concern.

One attempt to conserve power has been to integrate the modulator with the a turbine-generator by directly coupling a turbine impeller to a modulator rotor downstream from the impeller using a common drive shaft. The modulator rotor is further coupled by the drive shaft and a gear train located downstream of the modulator rotor to an alternator. The turbine impeller thus directly drives the modulator rotor as well as the alternator. This way the motor is not required to constantly "drive" the shaft and rotor, thus demanding much lower power. The motor only needs to speed up or slow down momentarily to encode data. However, problems arise due to fluctuations in mud flow rate and density altering the rotational speed of the turbine and thus the modulator rotor. Because the rotational velocity of the rotor controls the frequency of the base signal, if the rotor rotational speed is dynamic, the base signal frequency will also be dynamic, making demodulation of the signal difficult, if not practically impossible. As a solution, the speed of rotation of the modulator rotor is adjusted using a feedback control circuit and an electromagnetic braking circuit to stabilize the rotor speed and modulate the rotor to obtain the desired pressure wave frequency in the mud. However, during braking, power is not being generated by the alternator and thus the alternator is not able to supply power to the downhole tool components. The system thus requires that the alternator charge a capacitor during periods of non-braking so that during periods of braking, the charged capacitor can be used to provide power to the tool components instead of the alternator.

In addition to considerations of power requirements, modulator design must also be concerned with the telemetry scheme which will be used to transmit downhole data to the surface. The mud flow may be modulated in several different ways, e.g. digital pulsing, amplitude shift keying (ASK), frequency shift keying (FSK), or phase shift keying (PSK). Although energy efficient, amplitude shift keying is very sensitive to noise, and the mud pumps at the surface, as well as pipe movement, generate a substantial amount of noise. When the modulated mud flow is detected at the surface for reception of data transmitted from downhole, the noise of the mud pumps presents a significant obstacle to accurate demodulation of the telemetry signal. Digital pulsing which, while less sensitive to noise, provides a slow data transmission rate. Digital pulsing of the mud flow can achieve a data transmission rate of only about one or two bits per second. In FSK modulation, a number of cycles at a first frequency represents a "0" digital value, and a number of cycles at a second frequency represents a "1" digital value. PSK modulation uses the same carrier frequency for both a "0" value and "1" value, with different phase angles corresponding to the different digital values. A typical and conventionally used phase difference between "0" and "1" states in PSK modulation is 180°.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
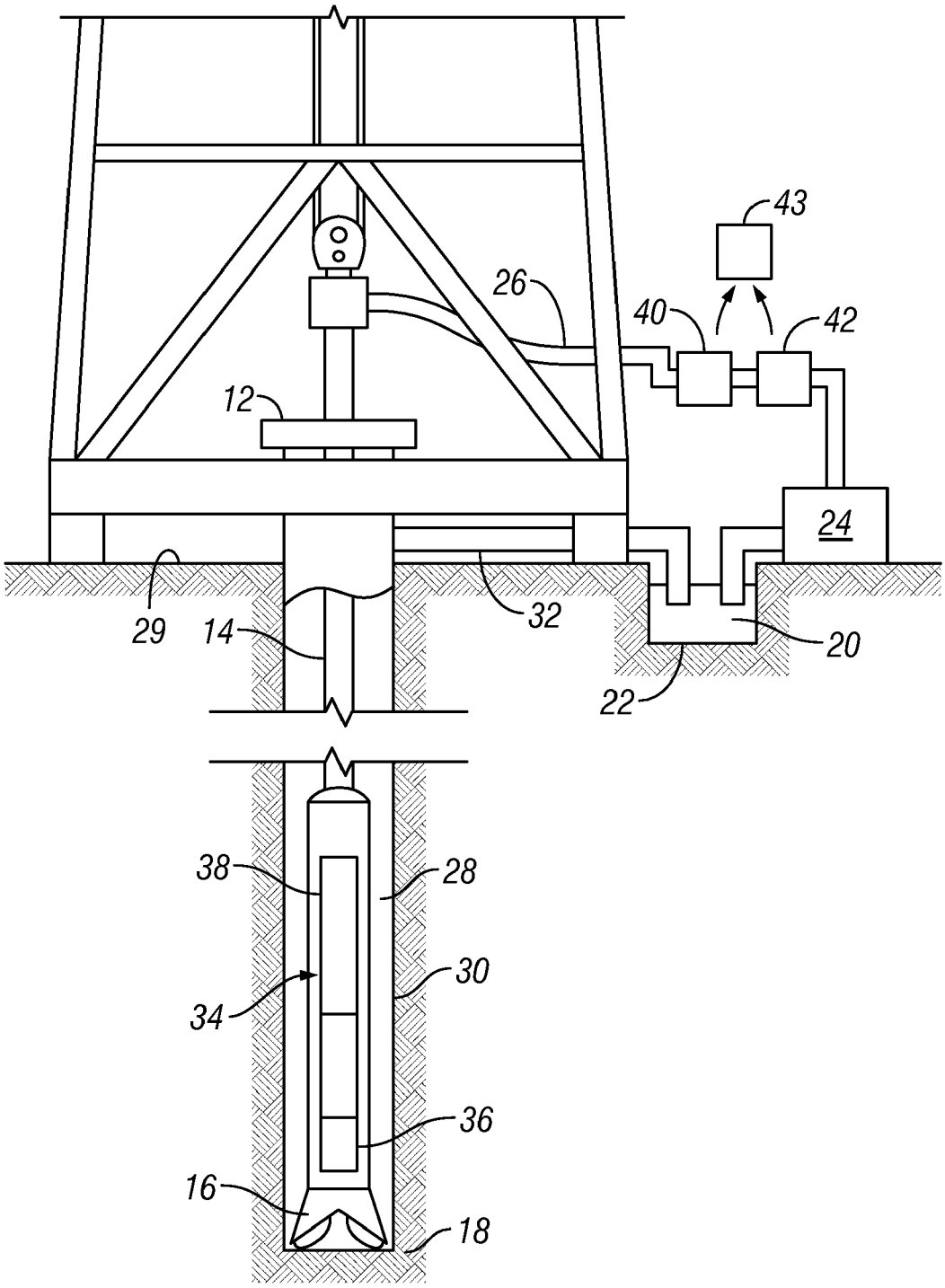
FIG. 1 is a schematic diagram of an MWD tool in its typical drilling environment.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a drilling rig 10 is shown with a rotary table 12 which provides a driving torque to a drill string 14. The lower end of the drill string 14 carries a drill bit 16 for drilling a hole in an underground formation 18. The drilling mud 20 is picked up from a mud pit 22 by one or more mud pumps 24 which are typically of the piston reciprocating type. The mud 20 is circulated through a mud line 26 down through the drill string 14, through the drill bit 16, and back to the surface 29 via the annulus 28 between the drill string 14 and the wall of the well bore 30. At the surface 29, the mud 20 is discharged through a line 32 back into the mud pit 22 where cuttings of rock and other well debris can be filtered before the mud is recirculated.

A downhole MWD tool 34 can be incorporated in the drill string 14 near the bit 16 for the acquisition and transmission of downhole data. The MWD tool 34 includes an electronic sensor package 36 and a mud flow telemetry system 38. The mud flow telemetry system 38 transmits a carrier signal by selectively blocking passage of the mud 20 through the drill string 14 to cause changes in pressure in the mud line 26. The telemetry system 38 then modulates the carrier signal to transmit data from the sensor package 36 to the surface 29. Modulated changes in pressure are detected by a pressure transducer 40 and a pump piston position sensor 42 which are coupled to a processor 43. The processor interprets the modulated changes in pressure to reconstruct the data sent from the sensor package 36.

Figure 2:
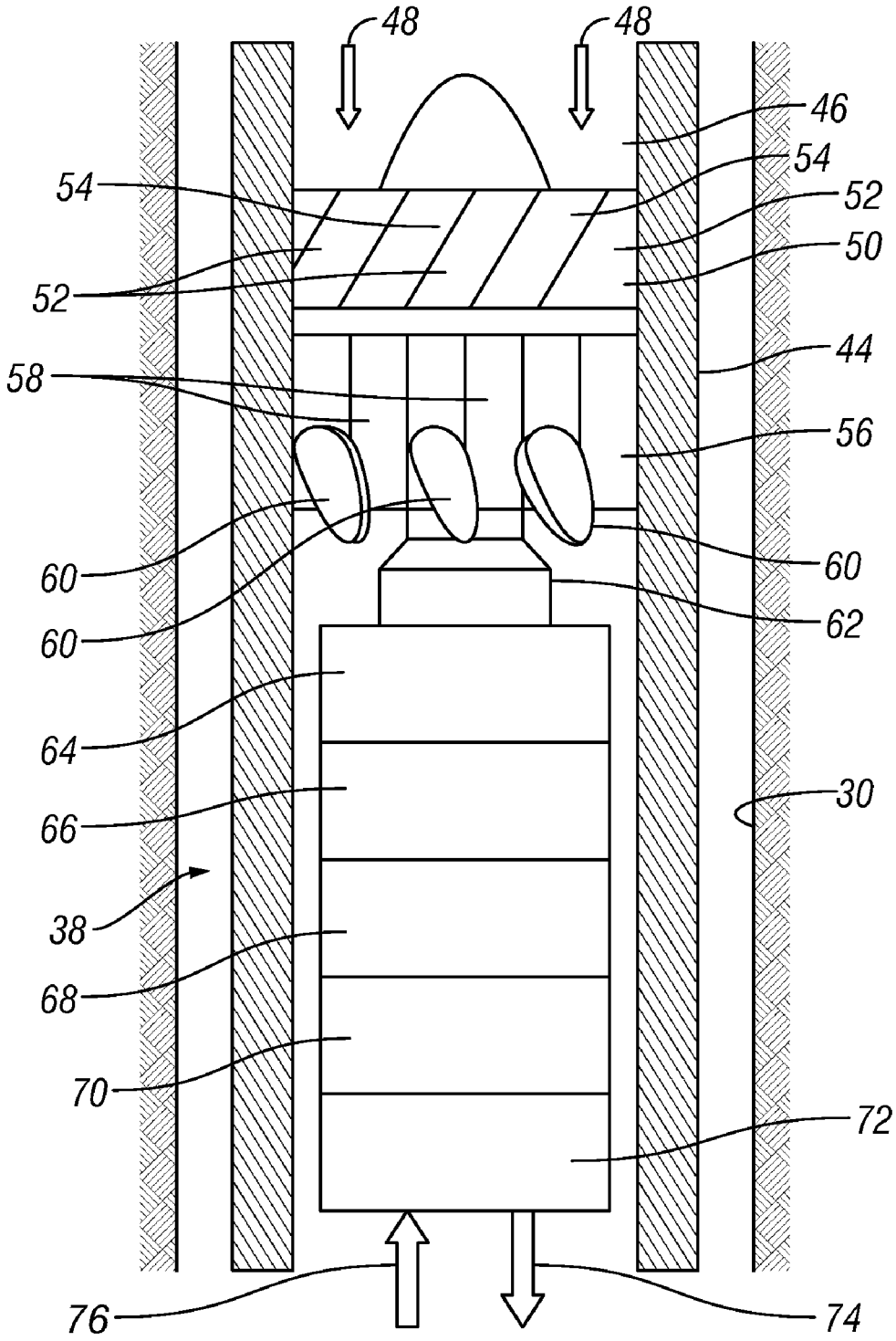
FIG. 2 is a conceptual schematic cross sectional view of a telemetry system used in the MWD tool.

Turning now to FIG. 2, one embodiment of the telemetry system 38 includes a housing 44 including an open end 46 into which the mud flows in a direction as indicated by the direction arrows 48. Mud flowing into the open end 46 flows into a stationary stator 50 that includes stator blades 52 and stator channels 54. As shown, the stator channels 54 are angled relative to the flow direction of incoming mud. The angled channels 54 impart a vortex flow on the mud as the mud passes through the stator 50. However, it should be appreciated that the stator channels 54 do not need to be angled in the direction as shown or at all. Mud flowing out of the stator 50 then flows into a rotor 56. Similar to the stator 50, the rotor 56 includes flow channels 58 that accept flow of the mud through the rotor 56 such that the vortex flow of the mud from the stator 50 imparts a rotational force on the rotor 56, causing the rotor 56 to rotate.

Additionally, the telemetry system 38 includes a regulating system that includes adjustable regulating fins 60 on the rotor 56 and an RPM regulator 64. The adjustable regulating fins 60 pivot with respect to the rotor 56, in effect acting as turbine blades that use the mud flowing through the rotor 56 to create additional rotational force on the rotor 56. Thus, the mud flowing through the rotor channels 58 imparts a rotational fluid force on the rotor 56 when the adjustable regulating fins 60 are angled with respect to the direction of flow. The RPM regulator 64 adjusts the position of the adjustable regulating fins 60 using any suitable means, such as a solenoid-controlled gearing arrangement within the rotor 56. Other suitable adjustment mechanisms may also be used however. It should be appreciated that in order to properly modulate the carrier wave, the rotational speed of the rotor 56 must be accurately regulated. Moreover, regulation must be accurate over a range of mud flow rates and mud densities. The RPM regulator 64 adjusts the adjustable regulating fins 60 to regulate the RPM of the rotor 56 to maintain the frequency of the carrier wave within a range of a target frequency even under the dynamic fluid flow rate conditions.

The rotor 56 is mounted on and drives a drive shaft that is rotationally supported within a device housing 62. The drive shaft extends within the device housing 62 and is coupled a gear train 66 which is in turn coupled with an alternator 68. The rotation of the drive shaft thus rotates the alternator 68, which uses a rotating magnetic field attached to the rotating shaft to generate electricity in stationary coils. The alternator 68 may alternatively use rotating coils on the rotating shaft and a stationary magnetic field. The alternator 68 thus generates voltage as a result of the rotating magnetic field cutting across the coils. The gear train 66 may be any suitable gear ratio for increasing the rotation rate of the drive shaft. For example the gear train 66 may have a gear ratio of 5:1. Due to the gear train 66, the rotation speed of the alternator 68 is thus 5 times faster than the rotation of the drive shaft. Thus, at a typical rotation of 1500 rpm of the drive shaft, the alternator 68 would rotate at 7500 RPM, providing approximately 50 to 500 Watts of power to downhole components. This energy can be stored downhole with either electronics (such as capacitors), chemically (such as rechargeable battery), or mechanically (such as flywheel means). The stored energy can be used to fill in the gap when the alternator fails to provide ample power for any reason.

Referring once again to FIG. 2, as the mud 20 enters the open end 46, it flows through the stator channels 54 and engages the rotor 56. The rotor 56 is designed to rotate as a result based, at least in part, on the position of the adjustable regulating fins 60. The rotation of the rotor 56 imparts a torque $T_1$ (in*lb) and an angular velocity w (RPM) to the drive shaft that is sufficient to overcome the drag torque $T_d$ of the gear train 66. Due to the 5:1 gear train 66, the rotation speed of the alternator 64 is 5 times faster than the rotation of the drive shaft.

Figure 3:
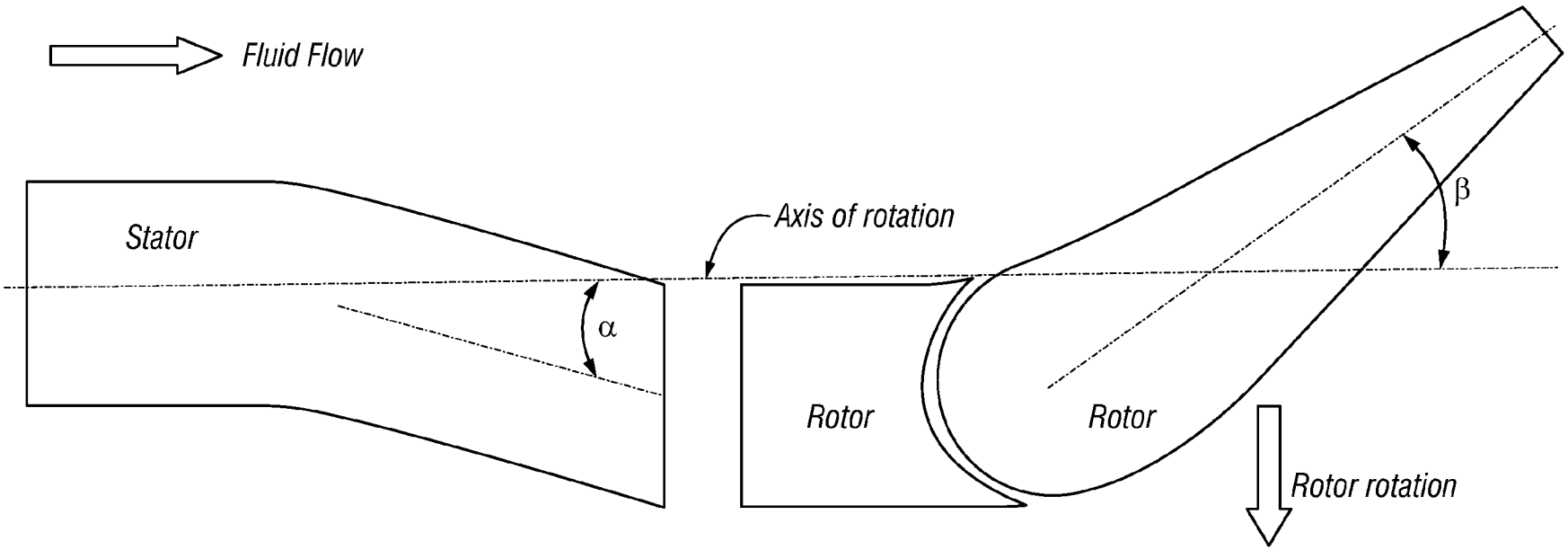
FIG. 3 is a schematic view of the stator and rotor angular positions respective to the center axis of the system.

For a given flow rate, the torque $T_1$ generated by the fins 60 will be inversely proportional to the angular velocity w of the drive shaft 54, according to:

$$T_1 = T_0\left(1 - \frac{\omega}{\omega_0}\right) - T_d \tag{1}$$

where $T_0$ is the stall torque (the maximum torque at 0 RPM) and $T_d$ is the drag/frictional torque loss at the fins. $\omega_0$ is the free spin RPM when there is no friction involved, which is determined by:

$$\omega_0 = k\frac{Q}{A}(\tan\alpha + \tan\beta) \tag{1a}$$

where k is a proportional constant, Q is the volume flow rate, and A is the total flow area at the fins. α and β are the trailing angles of the stator and rotor fins, respectively as shown in FIG. 3.

With a torque of $T_1$, the power $P_1$ (watts) delivered through the drive shaft by the rotor 56 is:

$$P_1 = \frac{T_1 \times w}{84.5} \tag{2}$$

where 84.5 is a units conversion factor to convert in*lb*RPM to watts. For different flow rates, the free spin RPM $w_0$ changes accordingly. The stall torque $T_0$ increases quadratically with increasing flow rate Q (GPM) and linearly with the density ρ (lb/gal) of the drilling mud 20. Thus, the stall torque $T_0$ is defined according to:

$$T_0 = n \times \frac{Q^2}{A} \times \rho(\tan\alpha + \tan\beta) \tag{3}$$

where n is a constant of proportionality (in*lb/GPM) relating stall torque to flow rate. Combining equations (1) through (3), the power $P_1$ from the turbine at any flow rate Q and mud density ρ may be expressed as:

$$P_1 = \frac{\omega}{84.5}\left\{\frac{nQ^2\rho}{A^2}(\tan\alpha + \tan\beta)\left(1 - \frac{\omega}{\omega_0}\right) - T_d\right\} \text{ or,} \tag{4}$$

$$P_1 = \frac{\omega}{84.5}\left\{\left[\frac{nQ^2\rho}{A^2}(\tan\alpha + \tan\beta) - T_d\right] - \frac{nQ\rho}{kA}\omega\right\} \tag{4a}$$

When the system is not controlled by a regulating mechanism, the RPM will be determined by the above equation (4a). Depending on the flow rate, and fluid density, as well as the power extracted from the turbine alternator, the system will find a balance RPM and the rotor/shaft will rotate at this speed. If any of the parameters in Eqs. 4 or 4a changes, a new balancing RPM will be established.

To achieve a predefined RPM value, any of these parameters can be altered to have the resulting RPM. However, some of the parameters may be hard to change or hard to maintain for a length of time. For example, the drag/friction torque can be changed, however, the heat generated by this torque may be harmful if the system is run for a period of time.

The flow rate and fluid density are usually determined by drilling needs, and may be changed periodically to satisfy the demands of well depth, formation, and formation pressure, etc. When they are changed during the drilling process, a predefined RPM (or a narrow range of) can be re-established by changing the other parameters, namely, the angles of fins (α and β) or flow area A.

The speed of the rotor 56 is controlled by a microprocessor (not shown) as part of the MWD tool 34 that is powered by the alternator 68. The microprocessor communicates with the RPM regulator 64 to adjust the position of the adjustable regulating fins 60 to regulate the RPM of the rotor 56 within a range. To do so, the RPM regulator 64 adjusts the adjustable regulating fins 60 to control the frequency of the carrier wave even under dynamic mud flow rate conditions. The actual RPM of the rotor 56 can be measured in any appropriate manner, such as a tachometer associated with the stator 56. The microprocessor compares the measured RPM to the desired RPM for the target carrier wave frequency. Any difference in the measured and target RPM is provided in a signal to the RPM regulator 64. The RPM regulator 64 then adjusts the adjustable regulating fins 60 based on the signal from the microprocessor to obtain the desired RPM for the target carrier wave frequency. For example, should the measured RPM be higher than the target RPM, the adjustable regulating fins 60 are adjusted to be more in-line with the direction of fluid flowing through the rotor 56, decreasing the resistance to flow. The decreased resistance to flow decreases the torque on the rotor 56 and thus decreases the RPM of the rotor 56. Should the rotor 56 not be rotating fast enough, the RPM regulator 64 adjusts the adjustable regulating fins 60 to interfere more with the fluid flowing through the rotor 56, increasing the resistance to flow. The increased resistance increases the torque on the rotor 56 and thus increases the RPM of the rotor 56. The RPM regulator 64 thus controls the RPM of the rotor 56 under different flow conditions so that the frequency of the carrier wave signal is maintained within a range. Thus, the range of frequencies is small enough and the change in frequency slow enough, that the processor on the surface remains able to demodulate the modulated carrier wave to reconstruct the data from the sensor package 36.

Those skilled in the art will appreciate that it is desirable to provide a rotor 56 with adjustable regulating fins 60 which cover the broadest flow range possible, perhaps from 100 to 1000 GPM for example. The maximum flow rate which can be tolerated by the alternator 68 can be maximized by selecting a large gear ratio and a gear train including a high efficiency. Additionally, the minimum flow rate needed by the rotor 56 to turn may be decreased by increasing the pitch angle of the adjustable regulating fins 60 which results in greater output torque per unit flow rate.

The telemetry system 38 is thus able to create a carrier wave of sufficiently constant frequency for demodulation at the surface. To modulate the carrier wave, the telemetry system 38 further includes a data embedding encoder 70 and a communications system 72 that includes a processor, a controller, and communications capabilities. The communications system 72 interacts with the remaining components of the MWD tool 34 such as the electronic sensor package 36. For example, the communications system 72 outputs power from the alternator 68 to the electronic sensor package 36 and other tool components such as the RPM regulator 64 as diagramed by output arrow 74. In addition, the communications system 72 receives data from the sensors of the electronic sensor package 36 as diagramed by input arrow 76. The communications system 72 also processes the data and transmits a signal based on the data to the data embedding encoder 70, which then embeds the data on the carrier wave. The data embedding encoder 70 embeds the data on the carrier wave by altering the speed of rotation of the rotor 56 to modulate the carrier wave using an appropriate modulation method. A typical system uses electromagnetism at the motor coil to drive or brake the shaft momentarily and achieve a shift in phase or frequency (RPM). The alternator output is usually smoothed to a substantially constant value by the power control electronics (not shown). The motor requirement on power supply may also be periodic and momentary such as in bursts, or it can also be in a continuous pulsing manner with a changing duty cycle.

Figure 4:
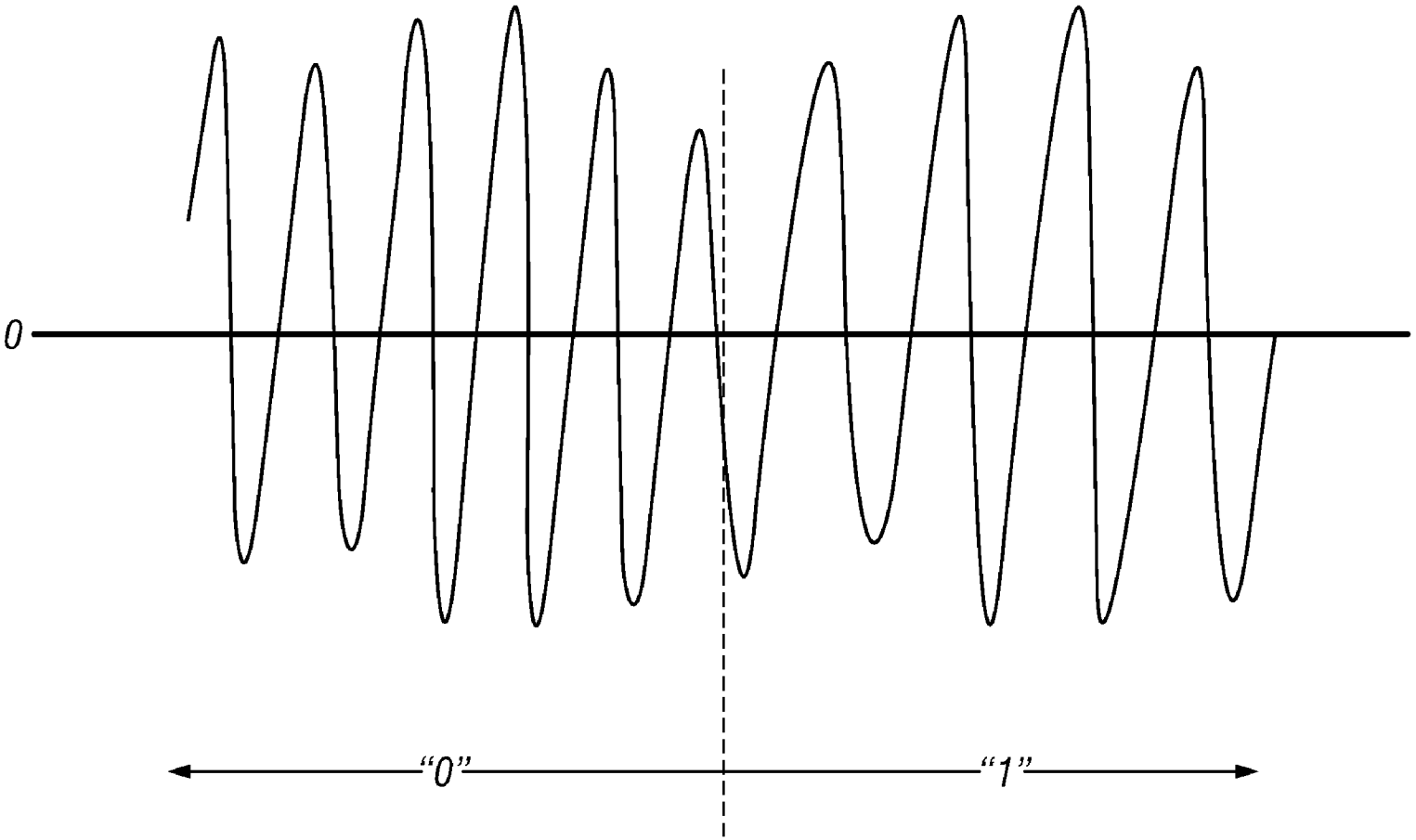
FIG. 4 is a diagram of a PSK signal phase shift.

An example of a modulation method includes a PSK modulation method that uses a single carrier frequency, indicating the transmitted digital data state by the instantaneous phase of the signal over the bit cell (i.e., the number of cycles of the carrier signal used to communicate a single bit). Referring to FIG. 3, an ideal PSK signal is illustrated in making a change from a "0" state to a "1" state. It should be noted that a bit cell, i.e., the number of cycles of the carrier signal used in establishing a single bit, may be larger than the portions shown in FIG. 3. For example, stress wave telemetry using compressional vibrations may use a carrier signal of 920 Hz communicating data at 50 Hz; as a result, eighteen cycles of the 920 Hz carrier signal are used to communicate each data bit (i.e., the "bit cell" is eighteen cycles). As shown in FIG. 4, an ideal transition changes phase in the amount of 180.degree. at a zero crossing point, with the "1" bit cell beginning immediately at the end of the "0" bit cell. Many media approach this ideal transition, particularly in hardwired and radio transmission.

Figure 5:
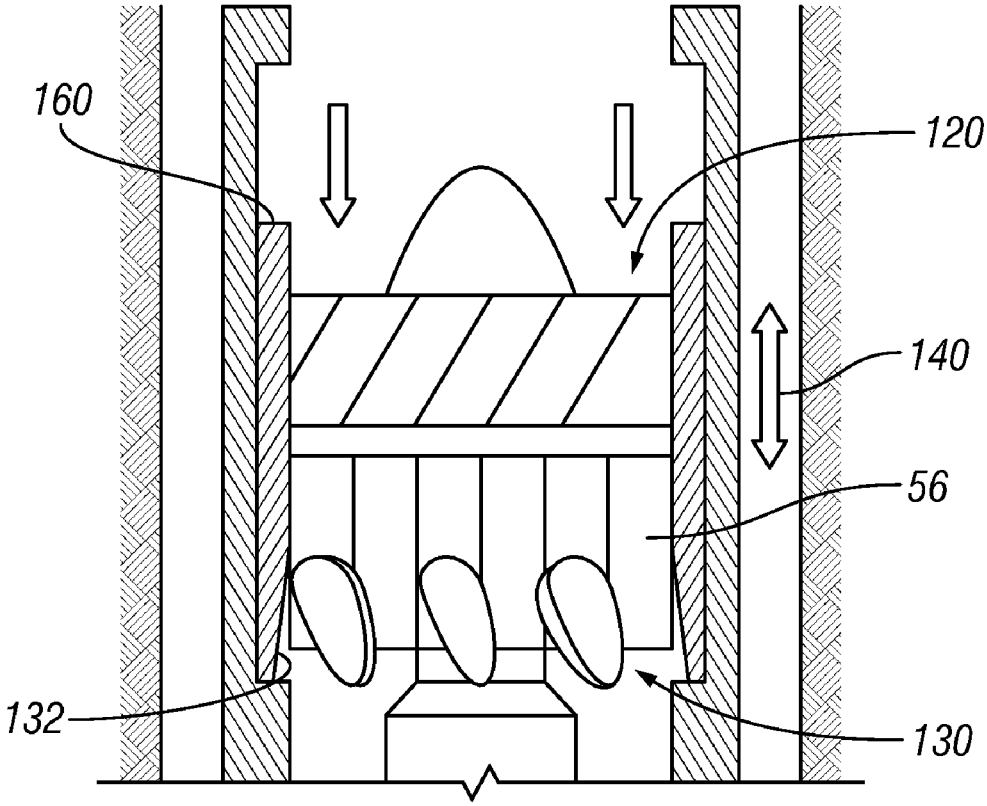
FIG. 5 is an alternative embodiment of a telemetry system.

As shown in FIG. 5, another embodiment of the telemetry device 138 includes similar components as the telemetry system 38. However the telemetry device 138 includes an alternative regulating system that includes an adjustable regulating sleeve 160 surrounding and slidable relative to the rotor 156. The alternative regulating system still includes an RPM regulator (not shown) that controls the position of the adjustable regulating sleeve 160 though any suitable means such as a linear actuator or a sliding rail driven by a rotating gear. The stator 50 is housed within the sleeve 160 and the sleeve 160 is slidingly housed within the housing 44. Also included is the rotor 56, either with or without the inclusion of the adjustable regulating fins 60. As shown in FIG. 4, the rotor 56 includes the fins 60 but it should be appreciated that the rotor 56 may be included without the fins 60 depending on the operating characteristics desired for the telemetry device 138.

As shown in FIG. 5, the adjustable regulating sleeve 160 is a generally cylindrical sleeve including an inlet end 120 and an outlet end 130. The interior of the sleeve 160 expands near the outlet end 30 a shown by sloped surface 132. During operation, the sleeve 160 slides axially relative to the rotor 56 as shown by direction arrow 140 under the control of the RPM regulator. As the sleeve 160 moves relative to the rotor 56, the shape of the interior of the sleeve 160 adjusts the amount of fluid actually traveling through the rotor 56 by adjusting the amount of area for fluid to flow around the outer surface of the rotor 56. In doing so, the sleeve 160 adjusts the amount of fluid force acting to rotate the rotor 56, thus also adjusting the RPM of the rotor 56. The sleeve 160 is adjusted to regulate the RPM of the rotor 56 within a range of a target RPM, thus controlling the frequency of the carrier wave under dynamic fluid flow conditions.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A downhole telemetry system for use in a wellbore including borehole fluid, the system including:

a stator including flow channels;

a rotor including flow channels and rotatable relative to the stator, wherein the rotor is coupled to a drive shaft and is configured to drive the rotation of the drive shaft in response to the flow of borehole fluid through the rotor;

the rotation of the rotor relative to the stator configured to create pressure variations in the borehole fluid related to the movement of the rotor channels relative to the stator channels, the pressure variations forming a carrier wave;

a regulating system configured to adjust the amount of fluid force on the rotor for a given flow rate of borehole fluid through the rotor to maintain the frequency of the carrier wave within a range of a target frequency;

an alternator drivable by the rotation of the drive shaft to provide power to the system; and an encoder configured to adjust the rotation of the rotor to modulate the carrier wave.

2. The system of claim 1 further including a communication system configured to receive and process data and communicate with the encoder to embed the data on the carrier wave.

3. The system of claim 1 where:

the communication system is configured to measure the RPM of the rotor and compare the measured RPM with a desired RPM for the target carrier wave frequency; and the communication system is configured to send a signal to the regulating system indicating an amount of adjustment of fluid force needed to obtain the desired RPM for the target carrier wave frequency.

4. The system of claim 1 wherein the regulating system includes:

an RPM regulator; and adjustable regulating fins that are adjustably attached to the rotor and associated with the fluid flow through the rotor channels, the adjustable regulating fins being adjustable by the RPM regulator; and adjustment of the regulating fins affecting the amount of rotational fluid force on the rotor for a given flow rate of borehole fluid through the rotor.

5. The system of clam 1 wherein the regulating system includes:

an RPM regulator; and an adjustable regulating sleeve adjustably surrounding the rotor and adjustable by the RPM regulator; and adjustment of the regulating sleeve affecting the amount of rotational fluid force on the rotor for a given flow rate of borehole fluid through the rotor by controlling the amount of fluid flowing through the rotor channels.

6. The system of claim 5 where the regulating sleeve is configured to control the amount of fluid flowing through the rotor channels by adjusting the amount of fluid flow area around the exterior of the rotor.

7. A drilling system for drilling a wellbore from the surface and including borehole fluid, the system including:

a drill string;

a drill bit attached to the drill string;

an MWD tool attached to the drill string and including a sensor package and a downhole telemetry system to transmit sensor data to the surface, the telemetry system including:

a stator including flow channels;

a rotor including flow channels and rotatable relative to the stator, wherein the rotor is coupled to a drive shaft and is configured to drive the rotation of the drive shaft in response to the flow of borehole fluid through the rotor;

the rotation of the rotor relative to the stator is configured to create pressure variations in the borehole fluid related to the movement of the rotor channels relative to the stator channels, the pressure variations forming a carrier wave;

a regulating system configured to adjust the amount of fluid force on the rotor for a given flow rate of borehole fluid through the rotor to maintain the frequency of the carrier wave within a range of a target frequency;

an alternator drivable by the rotation of the drive shaft to provide power to the system; and an encoder configured to adjust the rotation of the rotor to modulate the carrier wave;

a sensor on the surface to detect the modulated carrier wave; and a processor coupled to the sensor to demodulate the modulated carrier wave to reconstruct the sensor data.

8. The system of claim 7 further including a communication system configured to receive and process data and communicate with the encoder to embed the data on the carrier wave.

9. The system of claim 7 where:

the communication system is configured to measure the RPM of the rotor and compare the measured RPM with a desired RPM for the target carrier wave frequency; and the communication system is configured to send a signal to the regulating system indicating an amount of adjustment of fluid force needed to obtain the desired RPM for the target carrier wave frequency.

10. The system of claim 7 wherein the regulating system includes:

an RPM regulator; and adjustable regulating fins that are adjustably attached to the rotor and associated with the fluid flow through the rotor channels, the adjustable regulating fins being adjustable by the RPM regulator; and adjustment of the regulating fins affecting the amount of rotational fluid force on the rotor for a given flow rate of borehole fluid through the rotor.

11. The system of claim 7 wherein the regulating system includes:

an RPM regulator; and an adjustable regulating sleeve adjustably surrounding the rotor and adjustable by the RPM regulator; and adjustment of the regulating sleeve affecting the amount of rotational fluid force on the rotor for a given flow rate of borehole fluid through the rotor by controlling the amount of fluid flowing through the rotor channels.

12. The system of claim 11 where the regulating sleeve is configured to control the amount of fluid flowing through the rotor channels by adjusting the amount of fluid flow area around the exterior of the rotor.

13. A method of modulating a carrier pressure wave in a flow path of borehole fluid being circulated in a borehole, the method including:

forming a carrier wave by flowing borehole fluid through a rotor to drive the rotation of the rotor relative to a stator, the relative rotation creating pressure variations in the borehole fluid;

maintaining the frequency of the carrier wave within a range of a target frequency by adjusting the amount of fluid force on the rotor for a given flow rate of borehole fluid through the rotor;

producing power by driving an alternator from the rotation of the rotor; and modulating the carrier wave by adjusting the rotation of the rotor.

14. The method of claim 13 further including processing data for embedding on the carrier wave.

15. The method of claim 13 further including:

comparing a measured rotor RPM a desired RPM for the target carrier wave frequency; and determining an amount of adjustment of fluid force on the rotor needed to obtain the desired RPM for the target carrier wave frequency.

16. The method of claim 13 wherein the regulating system includes:

an RPM regulator; and adjustable regulating fins that are adjustably attached to the rotor and associated with the fluid flow through the rotor channels, the adjustable regulating fins being adjustable by the RPM regulator; and where adjusting the amount of fluid force on the rotor includes adjusting the position of the regulating fins.

17. The method of claim 13 wherein the regulating system includes:

an RPM regulator; and an adjustable regulating sleeve adjustably surrounding the rotor and adjustable by the RPM regulator; and where adjusting the amount of fluid force on the rotor includes adjusting the regulating sleeve to control the amount of fluid flowing through the rotor channels.

18. The method of claim 17 where adjusting the regulating sleeve controls the amount of fluid flowing through the rotor channels by adjusting the amount of fluid flow area around the exterior of the rotor.

* * * * *